US005852999A

United States Patent [19]

Chan

[11] Patent Number: 5,852,999

[45] Date of Patent: Dec. 29, 1998

[54] METHOD AND MEANS FOR GENERATING AND MAINTAINING SPARK IN A VARYING PRESSURE ENVIRONMENT

[75] Inventor: Anthony K. Chan, Peoria, Ill.

[73] Assignee: Caterpillar Inc., Peoria, Ill.

[21] Appl. No.: 799,337

[22] Filed: Feb. 13, 1997

[51] Int. Cl.[6] ..... F02P 15/10; F02P 3/01

[52] U.S. Cl. ..... 123/628; 123/606

[58] Field of Search ..... 123/606, 607, 123/608, 620, 628, 143 A, 295

[56] References Cited

U.S. PATENT DOCUMENTS

| | | | |
|---|---|---|---|
| 1,903,381 | 4/1933 | Kennedy | 123/305 |
| 2,402,539 | 6/1946 | Eitel | 123/148 |
| 2,484,009 | 10/1949 | Barber | 123/295 |
| 3,861,369 | 1/1975 | Canup | 123/148 E |
| 4,301,782 | 11/1981 | Wainwright | 123/620 |
| 4,328,771 | 5/1982 | Kawai et al. | 123/179.5 |
| 4,417,563 | 11/1983 | Brodie | 123/606 |
| 4,674,467 | 6/1987 | Tokura et al. | 123/606 |
| 4,710,681 | 12/1987 | Zivkovich | 315/209 T |
| 4,840,165 | 6/1989 | Hua | 123/606 |
| 4,881,512 | 11/1989 | Erskine et al. | 123/628 |
| 4,947,821 | 8/1990 | Somiya | 123/606 |
| 5,113,839 | 5/1992 | Hartmann et al. | 123/606 |
| 5,179,928 | 1/1993 | Cour et al. | 123/606 |
| 5,429,103 | 7/1995 | Rich | 123/643 |

*Primary Examiner*—Thomas N. Moulis
*Attorney, Agent, or Firm*—David L. Polsley

[57] ABSTRACT

Method and apparatus for generating and maintaining a spark in an environment having a varying pressure, such as a combustion chamber in an internal combustion engine, whereby a means for producing a high-frequency alternating electrical current is electrically connected to a pair of electrodes spaced apart by a gap and disposed in the combustion chamber for producing under the influence of a low applied electrical current, a continuous spark between the electrodes at a low pressure condition in the combustion chamber and maintaining the spark as the pressure in the combustion chamber becomes relatively high, aiding the ignition of combustible fuel injected into the combustion chamber during the high pressure condition.

10 Claims, 1 Drawing Sheet

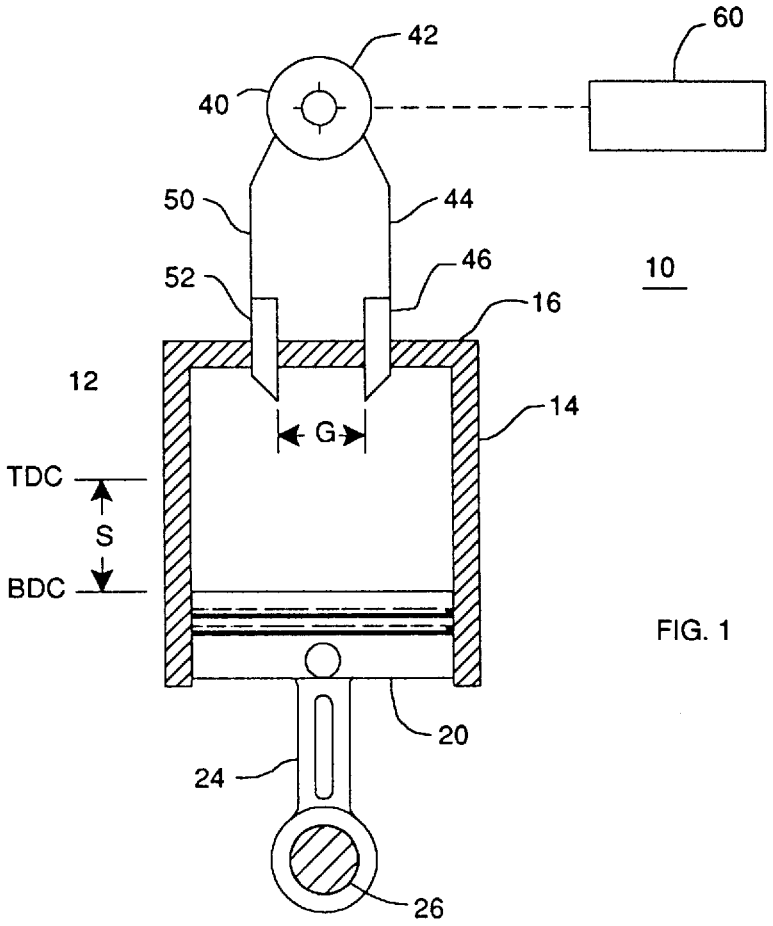
FIG. 1
FIG. 2
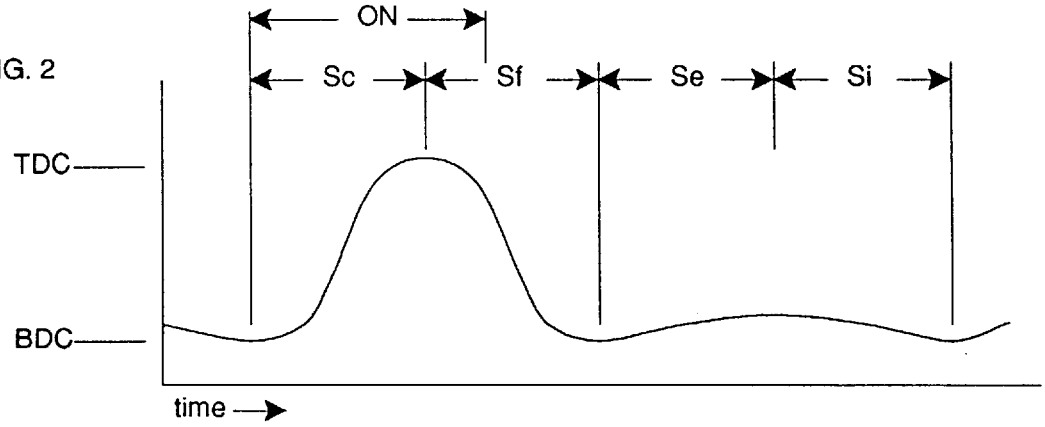

METHOD AND MEANS FOR GENERATING AND MAINTAINING SPARK IN A VARYING PRESSURE ENVIRONMENT

TECHNICAL FIELD

This invention generally pertains to internal combustion engine apparatus, and more particularly to apparatus and equipment for causing a desired spark generation within the cylinder of an internal combustion engine apparatus.

BACKGROUND ART

Most internal combustion engines provide at least one chamber of variable volume for combustion of a suitable air-fuel mixture. Many of these engines rely on a spark induced across two electrodes disposed within the chamber for initiation of combustion in the mixture. Such engines typically operate on the "Otto" thermodynamic cycle, employing gasoline, kerosene, and other such fuels. These engines commonly utilize a mechanically driven means for distributing a current to a spark plug extending into each successive combustion chamber, with the distribution timed to generate a spark in the spark plug which is coordinated with the compression of the air-fuel mixture in each successive combustion chamber.

Other engines, typically those operating on the "Diesel" thermodynamic cycle and employing a fuel oil such as No.1 or No. 2 diesel fuel, are capable of inducing ignition by compression of the air-fuel mixture under most operating conditions. However, under certain conditions, the diesel engine will also require a means for aiding combustion in the combustion chamber. This often occurs when the diesel engine is operating under ambient conditions of relative low temperature, or during start-up, when the engine apparatus is at a temperature substantially below the normal operating temperature. In such a case, the relative low temperature prevents the compressed air-fuel mixture from attaining the temperature necessary for the initiation of combustion.

In order to ensure proper ignition of the air-fuel mixture, diesel engines have typically been provided with electrically operated "glow plugs". These glow plugs are commonly operated by means of an electrical controller which simply ensures cyclical on-off operation thereof for a period of time after engine start-up is initiated.

Therefore, it is an object of the present invention to provide in an internal combustion engine apparatus a spark generating means having a relatively long life.

It is another object of the present invention to provide such a spark generating apparatus as will perform satisfactorily without regard to the type of fuel introduced into the engine apparatus.

It is another object of the present invention to provide such a spark generating apparatus as will initiate a spark in a combustion chamber at a relatively low voltage.

It is another object of the present invention to provide such a spark generating apparatus as will require relatively little electrical power.

It is a further object of the present invention to provide such a spark generating apparatus as will initiate and maintain a spark in a combustion chamber of such an engine apparatus during a compression stroke thereof.

It is another object of the present invention to provide such a spark generating apparatus as will be relatively simple, inexpensive to install, and as will require minimum maintenance.

These and other objectives of the present invention will become apparent in the specification and claims that follow.

SUMMARY OF THE INVENTION

The subject invention is a spark generating apparatus for use in an internal combustion engine operating on a variety of hydrocarbon fuels such as methanol, natural gas, or diesel fuel, wherein a high frequency alternating current generator is connected to two electrodes provided in a combustion chamber of the engine, with a spark therebetween being established when the piston is at bottom dead center and pressure in the combustion chamber is relatively low and the current and voltage requirements for sparking are relatively low, and maintaining the spark as the pressure rises under compression by the piston to top dead center to ignite fuel injected into the combustion chamber at top dead center.

BRIEF DESCRIPTION OF THE DRAWINGS

FIG. 1 discloses schematically a spark generating apparatus according to the present invention as employed in a representative reciprocating-piston type internal combustion engine.

FIG. 2 represents the changing pressure within the combustion chamber of the representative internal combustion engine during one cycle of the operation of the engine.

DESCRIPTION OF THE PREFERRED EMBODIMENT

A schematic representation of a single-cylinder reciprocating-piston type internal combustion engine incorporating the present invention is shown in FIG. 1 and referred to generally by reference number 10.

The exemplary engine 10 includes an engine block 12 having a cylindrical cylinder wall 14 and a cylinder head 16 acting as a closure on one end thereof. A cylindrical piston element 20 disposed within the cylinder wall 14 of the engine block 12 operates reciprocally within the cylinder wall 14. The piston 20, the cylinder wall 14, and the head 16 cooperate to define a combustion chamber of varying volume within the engine 10. The volume of the combustion chamber is at its minimum when the piston is at the top dead center position, and at its maximum when the piston 20 is at the bottom dead center position. The distance between the top dead center position and the bottom dead center position is the stroke S of the piston 20.

The piston 20 is connected by piston connecting rod 24 to a crankshaft. The crankshaft includes offset crankshaft portion 26 for translating the linear reciprocating motion of the piston 20 into rotary motion to provide a power means for obtaining power output from the engine 10, and further for translating rotary motion of the crankshaft into reciprocating motion of the piston 20 during those portions of the engine cycle when the piston 20 is not power producing.

Those skilled in the art will recognize that additional components are typically included in such an engine 10 as is exemplified herein. Other apparatus associated with such an engine 10 includes intake valves, exhaust valves, means for operating such valves, means for lubricating and tooling the engine 10, means for providing controlled fuel injection or intake, and other apparatus. It is believed that those skilled in the art are well acquainted with such apparatus and will be readily able to select such apparatus as is necessary to the satisfactory construction and operation of an engine 10. No particular form or type of such associated apparatus is necessary to the operation of the engine 10 other than that which is commonly employed in the art, and therefore such apparatus is not further discussed herein. Furthermore, of course, the subject invention is to be understood as applicable with equal suitability to multiple cylinder engines. Therefore, the engine 10 as set forth herein should be considered as exemplary and not limiting.

A spark generating apparatus or means 40 is shown in conjunction with the engine 10. The spark generating apparatus 40 includes a selectively controllable means for generating an alternating electrical current 42 when the spark generating apparatus 40 is in an ON condition, and generating no current when the spark generating apparatus 40 is in an OFF condition. This alternating current (AC) generating means 42 may be, for example, any commercially available high frequency AC generator 42, preferably capable of producing a relatively high frequency and high voltage electrical current of relatively low amperage.

The AC generator 42 is connected by a first conductor 44 to a first electrode 46 which extends through the cylinder head 16 into the combustion chamber, and a separate second conductor 50 connected to a second electrode 52 also extending through the cylinder head 16 into the combustion chamber. A controller 60 for selectively controlling the spark generating apparatus 40 to an on condition or an off condition is also provided.

The first electrode 46 and the second electrode 52 are spaced apart by a gap distance G within the combustion chamber for the transmission of an electrical current across an air gap between the first electrode 46 and the second electrode 52. This air gap G may be relatively small, for example, on the order of 0.020 inches to 0.080 inches. However, these measurements should be considered as exemplary only, since the air gap distance may be varied considerably as desired to better fit the operating characteristics of a particular engine 10, as those skilled in the art will recognize.

The spark generating apparatus 40 in the ON condition provides a high frequency alternating electrical current from the alternating current generating means 42 and through the first conductor 44 to the first electrode 46. This electrical current then bridges the gap G as a substantially continuous spark between the first electrode 46 and the second electrode 52. The current proceeds to the second electrode 52 and returns through the second conductor 50 to the alternating current generating means 42. In the OFF position, no electrical current is generated within the spark generating apparatus 40.

FIG. 2 discloses the operation of the spark generating apparatus 40 as it relates to the pressure of the gases within the combustion chamber during the operation of the engine 10. It must be understood that the graph disclosed in FIG. 2 is exemplary only, referring generally to the operation of engine 10 to disclose the operation of the spark generating apparatus 40 in relation to the pressure of gases within the combustion chamber and the strokes of the engine 10 during the operating cycle thereof. In the typical four-stroke operating cycle of the engine 10, the piston 20 operates from bottom dead center to top dead center on a compression stroke Sc to compress the gases contained within the combustion chamber. When the piston 20 reaches top dead center, the pressure is maximized, with an atomized fuel being injected into the engine to cause auto-ignition of a fuel air mixture resulting in the delivery of power to the engine 10 during the expansion stroke Sf of the engine 10. The firing and expansion stroke Sf is then followed by an exhaust stroke Se wherein the exhaust byproducts are permitted to exhaust from the engine at a relatively low pressure as the piston proceeds again from bottom dead center to top dead center. The exhaust stroke Se is followed by an intake stroke Si as the piston 20 moves from top dead center to bottom dead center. When the engine 10 is operated during conditions where auto-ignition of the fuel-air mixture is not properly occurring on the fuel injection and expansion stroke, the spark generating apparatus 40 is employed to ensure the proper ignition thereof.

In this condition, the spark generating apparatus 40 is set by the controller 60 to the ON condition when the piston 20 is at the bottom dead center position prior to the compression stroke Sc. The spark generating apparatus 40 is maintained in the ON condition throughout the compression stroke Sc, and may be maintained in the ON condition during all or a portion of the firing and expansion stroke Sf, as required to ensure assisted ignition of the fuel-air mixture within the combustion chamber. As the current across the gap G is established at the relatively low pressure of the bottom dead center position, a relatively low electrical current is required to establish the spark, and also to maintain the spark across the gap G during the high pressure regime at or near the top dead center position of the piston 20.

The preferred time of operation of the spark generating apparatus 40 is shown generally in FIG. 2. However, it will be understood by those skilled in the art that it is also possible to operate the spark generating apparatus 40 continuously during the four-stroke cycle of the piston 20 in the engine 10, since the spark generating apparatus 40 is capable of generating a continuous spark across the gap G during the low and high pressure portions of the operating cycle of the engine 10. However, it is preferred to operate the spark generating apparatus 40 during the shorter portion of the four-stroke cycle exemplified herein for the present enhancement of the operating life of the components of the spark generating apparatus 40, and therefore, the apparatus 40 will be set to OFF condition during at least a portion of the four-stroke cycle of the engine 10.

It will be readily apparent that the spark generating apparatus 40 as employed in the engine 10 provides numerous advantages. The spark generating apparatus 40 is relatively simple to install, and requires a relatively small number of components. For example, the spark generating apparatus 40 could satisfactorily replace the glow plug apparatus typically employed in diesel-type engines for assisted ignition conditions with a minimum of alteration to the typical engine 10. The spark generating apparatus 40 is a relatively low power electrical apparatus, employing a relatively low current, which will provide an enhanced operating life for the spark generating apparatus 40, with concomitant reduced maintenance and operating costs for the engine 10 in which such a spark generating apparatus 40 is employed. Furthermore, since the spark generating apparatus 40 employs a relatively low electrical current, the spark generating apparatus 40 is useful in auto-ignition engines employing fuels such as methanol or natural gas which often burn at a high local flame temperature and cause reduced life of the typical ignition assistance apparatus. These and other advantages will be readily apparent to those skilled in the relevant art.

Equivalent means, alternatives, and modifications to the preferred embodiment of the subject invention will be apparent to those skilled in the art within the scope of the claims that follow:

What is claimed is:

1. An internal combustion engine including a spark generating apparatus for aiding fuel ignition, said engine comprised of:

an engine block including a cylinder wall therein and a cylinder head thereon;

a piston disposed in said engine block for operating reciprocally within the cylinder wall between a top dead center position and a bottom dead center position, said piston cooperating with said cylinder wall therein and said cylinder head to define a combustion chamber in said engine having a low pressure condition at said bottom dead center position and a relatively high pressure condition at said top dead center position;

a selectively controllable alternating current generating means, said alternating current generating means having an ON condition at said low pressure condition when said piston is at said bottom dead center position prior to compression to said relatively high pressure condition, and maintaining said ON condition to said relatively high pressure condition when said piston is at said top dead center position, said selectively controllable alternating current generating means further maintaining said ON condition during an exhaust stroke from said relatively low pressure condition to said relatively high pressure condition, said alternating current generating means further having an OFF condition;

a first electrode in electrical connection with said alternating current generating means, said first electrode disposed in said combustion chamber;

a second electrode in electrical connection with said alternating current generating means, said second electrode disposed in said combustion chamber, and said second electrode spaced apart from said first electrode by a gap (G) whereby a substantially continuous spark can be established at the low pressure condition and maintained from said low pressure condition to said high pressure condition and during said high pressure condition in said combustion chamber.

2. The internal combustion engine (10) as set forth in claim 1 wherein said spark generating apparatus (40) further includes a controller (60) for selectively controlling said spark generating apparatus (40) between said ON condition for generating said spark and said OFF condition for generating no spark.

3. The internal combustion engine (10) as set forth in claim 2 wherein said spark generating apparatus (40) further includes a first conductor (42) for providing an electrical connection between said alternating current generating means (42) and said first electrode (44).

4. The internal combustion engine (10) as set forth in claim 3 wherein said spark generating apparatus (40) further includes a second conductor (50) for providing an electrical connection between said alternating current generating means (42) and said second electrode (52).

5. The internal combustion engine (10) as set forth in claim 4 wherein said alternating current generating means (42) generates a relatively high voltage electrical current.

6. The internal combustion engine (10) as set forth in claim 4 wherein said alternating current generating means (42) generates a relatively high frequency electrical current.

7. The internal combustion engine (10) as set forth in claim 6 wherein said alternating current generating means (42) generates said high frequency electrical current at a relatively low amperage.

8. The internal combustion engine (10) as set forth in claim 7 wherein said alternating current generating means (42) is a high frequency alternating current generator.

9. The internal combustion engine (10) as set forth in claim 8 wherein said controller (60) actuates said spark generating apparatus (60) to said ON condition for generating a spark in said combustion chamber when said piston (20) is at the bottom dead center position of a compression stroke Sc for compressing air in said combustion chamber.

10. The internal combustion engine (10) as set forth in claim 8 wherein said controller (60) maintains said actuation of said spark generating apparatus (40) for generating a spark in said combustion chamber from the bottom dead center position of said piston (20) to the top dead center position of said piston (20).

* * * * *